US012325066B2

(12) United States Patent
Naik

(10) Patent No.: US 12,325,066 B2
(45) Date of Patent: Jun. 10, 2025

(54) CASTING FURNACE FOR SOLIDIFICATION RESTRUCTURING (FSR)

(71) Applicant: Rajeev Naik, Yorktown, VA (US)

(72) Inventor: Rajeev Naik, Yorktown, VA (US)

( * ) Notice: Subject to any disclaimer, the term of this patent is extended or adjusted under 35 U.S.C. 154(b) by 0 days.

(21) Appl. No.: 18/610,230

(22) Filed: Mar. 19, 2024

(65) Prior Publication Data

US 2024/0316626 A1 Sep. 26, 2024

(51) Int. Cl.
*B22D 45/00* (2006.01)
*B22D 27/04* (2006.01)

(52) U.S. Cl.
CPC ..... *B22D 45/00* (2013.01); *B22D 27/045* (2013.01)

(58) Field of Classification Search
CPC ..... B22D 27/04; B22D 27/045; B22D 45/00
USPC ..... 164/335, 338.1, 348
See application file for complete search history.

(56) References Cited

U.S. PATENT DOCUMENTS 5,921,310 A 7/1999 Kats et al.
6,311,760 B1 11/2001 Fernihough et al.
10,082,032 B2 9/2018 Naik
10,717,617 B2 7/2020 Miyagawa et al.
2013/0022803 A1* 1/2013 Schaeffer et al. ..... F01D 5/147 164/122.2

FOREIGN PATENT DOCUMENTS

EP 2436461 A2 * 4/2012 ..... B22D 27/045
EP 2727669 A2 * 5/2014 ..... B22D 25/02

* cited by examiner

*Primary Examiner* — Kevin P Kerns
(74) *Attorney, Agent, or Firm* — Invention Matters LLC; Edwin De Angel

(57) ABSTRACT

A casting furnace includes a melting chamber, a dual zone mold heating chamber, and a dual zone mold cooling chamber. The melting chamber provides a source of molten alloy or ceramics with adequate superheat. The dual zone mold heating chamber includes an independently controlled primary heating zone and a secondary heating zone. The primary heating zone raises the mold temperature adequately to impart high gradient solidification conditions. The secondary heating zone assists the primary heating zone to minimize overheating of the majority of the mold. The dual zone mold cooling chamber includes a primary cooling chamber and a secondary cooling chamber. The primary cooling chamber speeds up solidification in order to prevent defect formation and refine microstructure. The secondary cooling chamber slows down the cooling of castings to reduce residual stresses build up and minimize elemental segregation through augmenting solid-state diffusion of lower melting elements.

6 Claims, 5 Drawing Sheets

CASTING FURNACE FOR SOLIDIFICATION RESTRUCTURING (FSR)

CROSS-REFERENCE TO RELATED APPLICATIONS

This application claims priority to and benefit of Indian patent application number Ser. No. 202341019538, filed on Mar. 21, 2023, the contents of which are incorporated by reference in its entirety.

FIELD OF INVENTION

The present invention relates to a casting furnace for restructuring of metals and/or ceramics and more particularly resulting from improved thermal processing conditions for control of microstructure and elemental segregation so that the resulting components are relatively free of defects and microstructural inhomogeneity normally associated with conventional cast parts. The invention encompasses refining of all types of cast structures including random and directional oriented metals such as gas turbine blades and/or ceramics and magnetic materials with specific directional properties.

BACKGROUND OF INVENTION

The increased demand for gas turbines with greater power and efficiency have significantly expanded the need for more complex, lighter in weight and larger in size cast components with improved soundness, reduced segregation and optimum microstructure. To achieve increased power and efficiency, the turbine needs to be not only larger but also have to operate at much higher temperature to enhance fuel combustion and thrust. Cast components with single crystal or columnar structure that can operate at much higher temperature than conventional random crystal structure because of reduced grain boundaries and favorable crystal orientation to the stress axis are increasingly used in these turbines. Improved soundness and homogeneity along with preferred crystal orientation is required to improve reliability of these components.

In the past, the conventional practice of manufacturing of castings was to pour metal into a mold cavity and let the entire casting transform from the molten to solid state. Solidification of this metal was mostly dictated by casting cross sections and has been relatively uncontrollable because different sections froze at different times. The solidification time and the reservoir of the metal above determined the casting soundness and structure and ultimately the mechanical properties. Therefore, the properties of casting solidified in the conventional manner, will vary in proportion to the solidification pattern/structure achieved. The economy and product performance dictates development of new processes with enhanced filling and feeding characteristics that promote progressive solidification of metal to impart castings with uniform structure and improved soundness. Progressive solidification under high gradient conditions provides the ideal situation for control of solidification microstructure while enhancing the feeding of molten alloy from the molten alloy reservoir above to improve casting soundness.

A directional solidification casting method, which is commonly known as Bridgman method, is typically used to produce single crystal or columnar cast structure. In this method, the molten metal is poured in to a mold maintained considerably above the melting point of the alloy in a mold heating chamber and then the mold is withdrawn gradually from hot mold chamber to a cooler lower chamber. The metal solidifies in the lower chamber due to radiation heat loss or the use of a water-cooled chill plate. The resultant crystal structure is primarily influenced by the rate of mold withdrawal, temperature gradient at the solidification boundary between the heating and cooling chambers. The temperature gradient in itself is influenced by the type of the alloy, amount of heat contained in the mold and rate of heat loss and therefore, a small mold with less metal will solidify under higher thermal gradient due to reduced heat contained in the mold and faster heat loss. A higher temperature or thermal gradient invariably results in finer microstructure through formation of many crystals.

It is a well-known fact that the refinement of microstructure requires solidification of alloys under very high gradient and controlled solidification rate. Literature survey shows several studies have been completed to document the effect of gradient, solidification and cooling rate of castings on their microstructure, carbide and gamma precipitate sizes. It is also well documented with increase in gradient and solidification rate, primary dendrite and secondary dendrite spacings decrease gradually, the morphology of gamma prime precipitates changes from cuboidal to spherical and distribute more uniformly in both dendritic and inter-dendritic regions. The refinement of microstructure and precipitates significantly improve both creep and low cycle fatigue properties which are critical to long term functioning of the turbine blades which rotate under very high speed and are subjected very high temperature and pressure.

In casting of large molds with many cast components and/or casting of large last stage blades, thermal gradient for solidification becomes inadequate leading to formation of coarser cast structures with increased solidification related defects, segregation and porosity. Also, the limited heat extraction possible at lower thermal gradient invariably results in excessively long casting time leading to lower productivity. Therefore, casting of large final stage blades, which are increasingly in demand because of higher power output required from the turbines, require an ultra-high gradient furnace capable of faster rate of directional heat extraction. In addition to the increased production rate, a faster solidification rate results in castings with significantly finer crystal structure, reduced defects, improved soundness and homogeneity. Refined microstructure significantly enhances fatigue properties of turbine blades while the reduced segregation assists in post cast processing of castings to homogenize microstructure which improves creep life of turbine blades. Reduced segregation helps optimization of heat treat parameters to avoid recrystallization or incipient melting scrap which are prevalent in conventional castings with high localized segregation. Ultra-high gradient furnace, because of its ability to extract a directionally large amount of heat, provides the ideal solidification conditions needed for the manufacture of large complex turbine blades with highest performance and reliability at a high production rate.

Some of the conventional Bridgman casting units containing a single heating zone and radiation cooling have been disclosed in the past. For example, United States granted U.S. Pat. Nos. 10,717,617, 10,082,032, 6,311,760 and 5,921,310 disclose the use of additional gas or liquid cooling to increase heat extraction. The cooling suggested in the above disclosures constitute active cooling with high pressure gas directed on the mold with nozzles to impart turbulent or supersonic cooling.

Therefore, there is a need in the art to provide an improved casting furnace for restructuring of metals and/or ceramics.

SUMMARY OF THE INVENTION

It is an object of the present invention to provide an improved casting furnace that avoids the drawback of known furnaces.

It is another object of the present invention to overcome the above-mentioned problems and difficulties encountered in conventional casting of large molds with many components and/or large blades that contain large amounts of heat through improvement of solidification thermal gradient and cooling.

It is another object of the invention to provide a superior casting furnace with high heat extraction capability for manufacture of large sized molds or increased number of parts of desired soundness and microstructure including directional and non-directional in a shorter time thus enhancing productivity.

It is yet another object of the invention is to control nucleation and growth of crystals through optimization of thermal gradient and withdrawal rate at the solidification boundary to refine primary and secondary dendrite arms spacing of crystals. The reduced primary spacing should help in minimizing elemental segregation and porosity while decreasing the propensity for formation of solidification defects. The finer microstructure and reduced segregation should considerably aid in improvement of low cycle fatigue properties.

It is yet another object of this invention is to provide appropriate thermal conditions to promote diffusion of interstitial elements such as carbon and boron, and harmful trace elements such as zirconium, silicon, and substitutional element such as aluminum and titanium to improve heat treatability and final properties of the casting including creep.

The casting furnace of the present invention contains a unique mold heating chamber and mold cooling chamber and a standard melt chamber. The purpose of the melt chamber is to provide the necessary source of molten alloy or ceramics for production of the component and hence is not discussed in detail. The mold heating chamber comprises two independently controlled heating units or zones i.e., a primary heating zone and a secondary heating zone. The secondary heating zone operates above the melting point of the alloy but a lot colder than the conventional directional solidification casting furnace. This helps not to excessively superheat the metal and ceramic mold/core thereby reducing the extent of the mold-metal reaction, distortion of ceramic mold/core which negatively impacts casting yield. By raising the mold sufficiently near the casting temperature, the secondary heating zone helps to reduce the heat needed in the primary heating zone thereby improving flexibility and control for the primary heating zone. The primary heating zone provides an additional source of heat to bring the melt and mold temperature above those used in conventional Bridgman casting furnaces. The higher mold temperature of the primary heating zone combined with much lower mold temperature of primary cooling zone attained in the present invention, imparts the increased thermal gradient for solidification needed for growth of directional crystals. The purpose of the secondary mold cooling unit or the secondary cooling chamber is to affect the cooling rate of casting thereby promoting solid state diffusion of lower melting and interstitial elements. The principle of the present invention is based on control of temperature and heat extraction rate needed at critical locations in each zone to provide the optimum solidification conditions for control of crystal nucleation and growth and hence restructuring.

In one advantageous feature of the present invention, the cooling achieved is passive, and does not need the use of nozzles to generate turbulent cooling and the gas pressure is low enough to facilitate recirculation without the need for expensive compression units. The present invention uses double heating and dual cooling systems to impart precise control of temperature and temperature gradient across the solidification front for restructuring of metals with fine structure, reduced segregation and improved soundness.

Features and advantages of the subject matter hereof will become more apparent in light of the following detailed description of selected embodiments, as illustrated in the accompanying FIGURES. As will be realised, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

Further features and advantages of the present subject matter will become apparent from the following detailed description, taken in combination with the appended drawings, in which.

Figure 1:
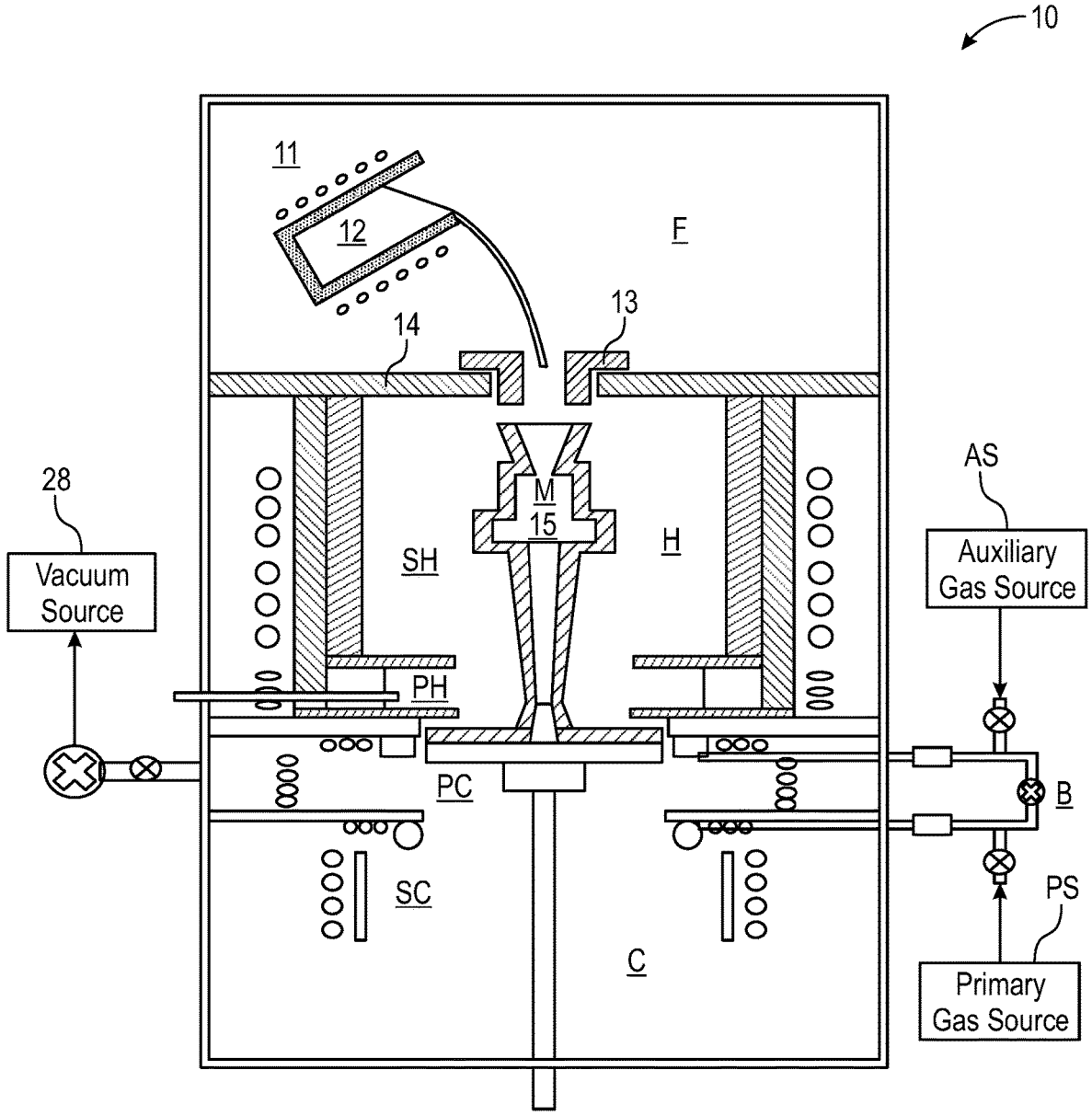
FIG. 1 is a schematic illustration of a casting furnace with a standard melt chamber and unique dual zone mold heating and unique dual zone cooling chambers, in accordance with one embodiment of the present invention.

It will be noted that throughout the appended drawings, like features are identified by like-reference numerals.

DETAILED DESCRIPTION OF THE EMBODIMENTS

The detailed description set forth below in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed casting furnace. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed casting furnace.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present subject matter encompasses present and future known equivalents to the known components referred to herein by way of illustration.

Although the present subject matter describes a casting furnace, it is to be further understood that numerous changes may arise in the details of the embodiments of the casting furnace. It is contemplated that all such changes and additional embodiments are within the true scope of this subject matter.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the subject matter and are not intended to limit the scope of the subject matter.

It should be understood that the present invention describes a novel casting furnace for manufacture of metal and/or ceramic components at high production rate. The furnace includes dual heating and dual cooling zones to regulate both the heat content and heat extraction rate from the ceramic mold to grow crystals of desired density, orientation and microstructure. The furnace with upper mold heating chamber containing dual heating zones and a lower mold cooling chamber containing dual cooling zones enables to regulate the heat extraction rate necessary to affect the restructuring of crystals during primary solidification in the molten state; and a reduction of secondary segregation in the solid state. This restructuring which encompasses refinement of microstructure, improvement in soundness and segregation significantly results in improvement properties those are of critical importance for high temperature performance of turbine blades and quality of ceramics. The aforementioned unique mold heating and cooling chambers along with a standard induction melting chamber to supply the molten metal or ceramic constitute the essential components of this advanced casting furnace.

Various features and embodiments of a casting furnace are explained in conjunction with the description of FIGS. 1-5.

Referring to FIG. 1, one form of a casting furnace 10 for precise control of temperature profiles at the solidification front based on optimization of heat extraction rate specifically tuned to the heat content of the mold is shown, in accordance with one embodiment of the present invention. The casting furnace 10 consists of three chambers, i.e., a melting chamber M within a furnace F, a mold heating chamber H and a mold cooling chamber C. The melting chamber M preferably contains an induction furnace 11 to melt the alloy in a crucible for providing the source of a molten alloy 12 at the right temperature necessary for pouring into a mold through pour inlet 13. The melting chamber M is isolated from the mold heating chamber H by a thick insulating top cover 14 usually made up of graphite. The melting chamber M includes a mold cavity 15. The mold cavity 15 forms a tortuous path through which molten alloy will travel as it fills the mold. Preferably, the mold heating chamber H is characterized as being composed of thin-walled structures made by the standard investment casting process with higher thermal transfer properties. A mold heating chamber H which is thin and very conductive is preferred in this process to reduce both heat content of the mold as well as facilitate rapid heat extraction.

Figure 2:
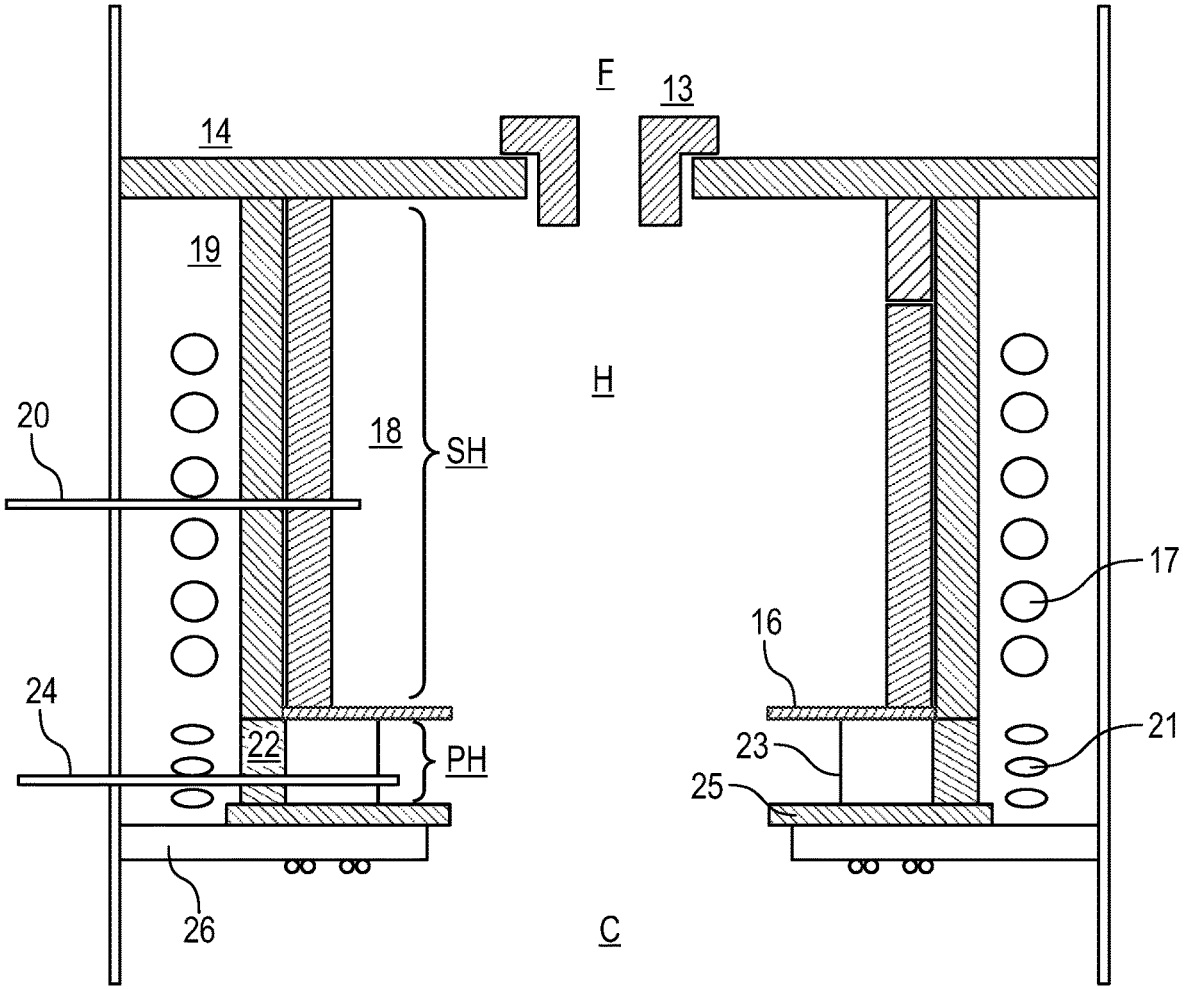
FIG. 2 is an illustration of a mold heating chamber, in accordance with one embodiment of the present invention.

Referring now to FIG. 2, another embodiment of the present invention is shown in which the mold heating chamber H consists of two independent heating chambers i.e., a primary heating zone PH and a secondary heating zone SH. The primary heating zone PH and the secondary heating zone SH are separated by a baffle 16. The secondary heating zone SH helps to maintain the mold sufficiently above the melting point of the alloy but at much lower temperature than in the conventional process. For example, in a conventional process with single heating, a furnace controlled at 2800° F., the middle zone can easily overheat by 150° F. to 250° F. whilst the mold in the present invention can be about 100° F. cooler because of independent secondary heating control. Most conventional ceramics creep/distort when exposed to temperatures in excess of 2800° F. for prolonged time resulting in increased dimensional scrap and leakers. The considerably reduced temperature to which the mold is exposed in the present invention, will permit faster rate of heat extraction leading to increased rate of production. The lower mold temperature also helps to reduce extent of mold-metal reaction especially with reactive alloys, elemental segregation, bulging of molds and leakers.

The secondary heating zone SH comprises a special induction coil 17 that is widely spaced to provide dispersed heating. Further, the secondary heating zone SH comprises a susceptor or graphite heating material 18 and an insulation material 19 and source of the power supply are similar to the one used in single zone heating. Here, a dual thermocouple 20 is used to control and monitor the temperature of the secondary heating zone SH.

The purpose of the primary heating zone PH is to raise the temperature of the molten alloy in the mold at least 50° F. above those used in the conventional process for a short time to enhance thermal gradient of solidification. The primary heating zone PH is hence designed to be short in length with a high heat source and is typically about 20% of the total height of the entire heating zone. The primary heating zone PH contains a very closely spaced coil 21 to provide an intense heat in a very narrow zone. The primary heating zone PH includes a heating material 22 and the insulation 23 are designed to be thicker to retain heat as well prevent leakage of flux. The primary heating zone PH comprises a dual thermocouple 24. The dual thermocouple 24 controls and monitors the temperature of the primary heating zone PH. Unlike the entire furnace to be raised to the very high temperature needed near the solidification boundary in the conventional process, the present invention allows the primary heating zone PH to be at the highest temperature at the solidification zone needed to grow directional crystals, without superheating the rest of the mold.

The dual heating zones i.e., the primary heating zone PH and the secondary heating zone SH with independent controls, provide significant flexibility for maintaining the optimum temperature where needed. The increased temperature of the primary heating zone PH along with the cooler temperature of a primary cooling zone PC, in the present invention, leads to conditions desired for higher thermal gradient of solidification. The primary heating zone PH is isolated from the primary cooling zone PC below by a composite baffle 25. This baffle system is supported on a water-cooled copper shelf 26 which also helps to shield leakage of magnetic field. In order to achieve the higher gradient of solidification in the present invention, the higher primary heating zone PH temperature is coupled with lower temperature of the primary cooling zone PC. The temperature of the primary heating zone PH and the primary cooling zone PC, in addition with controlled withdrawal rate to regulate the amount of metal entering the solidification boundary between the primary heating zone PH and the primary cooling zone PC provides the ultra-high solidification conditions needed.

Figure 3:
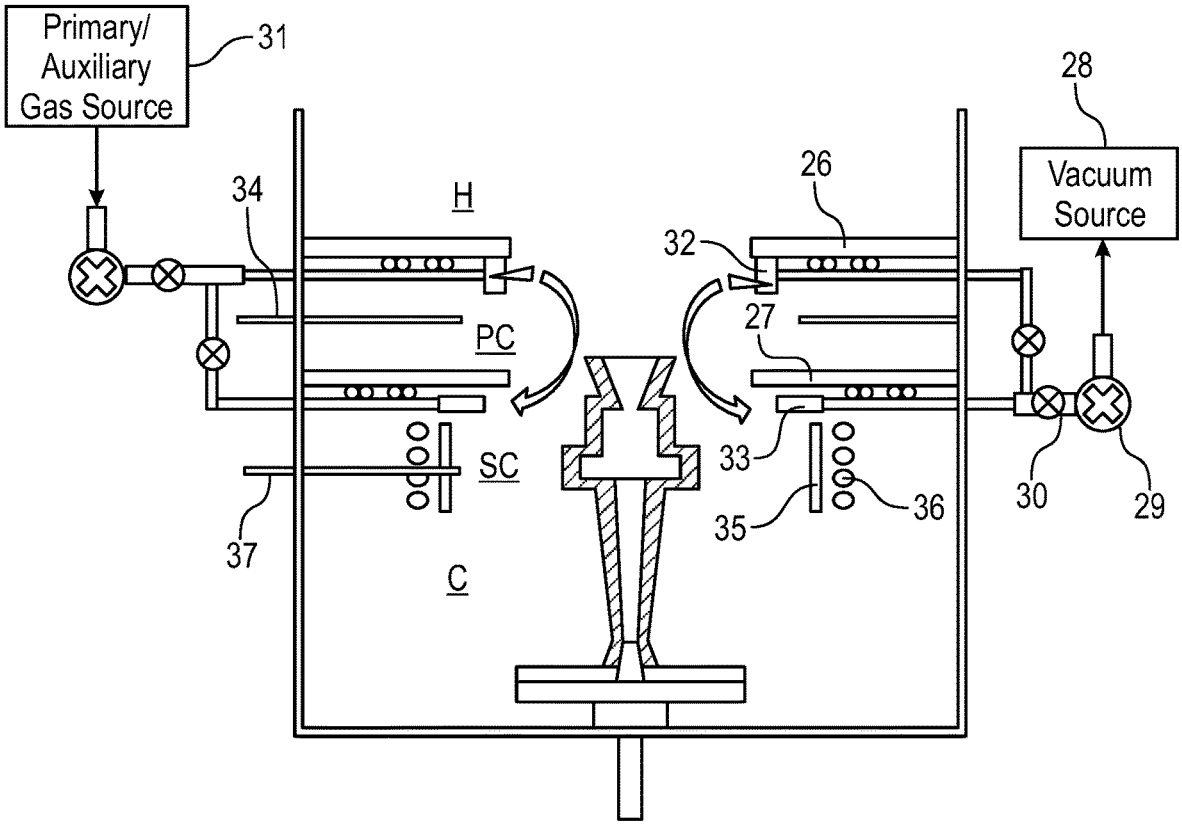
FIG. 3 is an illustration of a mold cooling chamber, in accordance with one embodiment of the present invention.

Referring now to FIG. 3, another embodiment of the present invention is shown in which the mold cooling chamber C consists of a primary cooling chamber PC and a secondary cooling chamber SC separated by a water-cooled metal baffle 27. The mold cooling chamber C is connected to a suitable vacuum source 28 via a pump 29 incorporating a vacuum valve 30. The mold cooling chamber C can also be connected to sources such as auxiliary gas source AS and a primary gas source PS via a blower B for an auxiliary fluid cooling 31. In the majority of the cases, a cooling gas is introduced in the secondary cooling chamber SC through a manifold 32 and pulled out of a manifold 33 in the primary cooling chamber PC. The intake and exhaust manifolds 32; 33 contain several dozen holes' precision drilled in preselected direction, the diameter and number of these holes are based on the volume flow of gas, residual pressure of gas in the chamber and the pressure of gas at inlet. The exhaust gas can be reused, if and when necessary, through a combination of reversible recirculation pump and heat exchangers/chillers to lower the gas temperature. A dual thermocouple 34 is used to monitor and control the temperature of the primary cooling zone PC.

The gas cooling system used in the present invention is passive and does not use high pressure to induce supersonic velocities as stated in several earlier inventions. A lower pressure of the gas used in this invention also facilitates recirculation of gas, if required without the need for expensive compression units. The gas cooling system employed varies based on the materials being cast and may compose of evaporative, endothermic and reactive cooling. The design of the intake and exhaust manifolds with multiple pre-inclined holes is critical to improve the robustness of the primary cooling.

The narrow and unique designs of the primary heating and primary cooling zones in the present invention along with optimization of mold withdrawal rate to allow small amounts of molten alloy to pass through the baffle, permits maximum directional heat extraction needed for solidification under ultra-high thermal gradient. The furnace of present invention is capable of achieving a thermal gradient in excess of 450° F./inch with optimization of complex composite baffle when primary heating zone PH and the primary cooling zone PC temperatures compared to about 150° F./inch typically achieved in conventional Bridgman furnaces. Solidification under higher thermal gradient facilitates refinement of structure resulting in improved soundness and homogeneity.

The purpose of the secondary cooling chamber SC is to minimize the heat loss from the mold to slow down the cooling of the metal solidified in the primary cooling zone PC. A slower cooling provides adequate time for diffusion of trace, interstitial and lighter elements such as aluminium to homogenize microstructure which further helps to improve heat treat solution treatment. The slow cooling also helps to minimize build-up of residual stress in castings which can lead to increased tendency for distortion or cracking of casting containing variable cross sections. An insulated metal shield 35 preferably through a resistance or induction heating coil 36 can be used to slow down casting heat loss. A dual thermocouple 37 is used to monitor and control temperature of the secondary cooling chamber SC.

Figure 4:
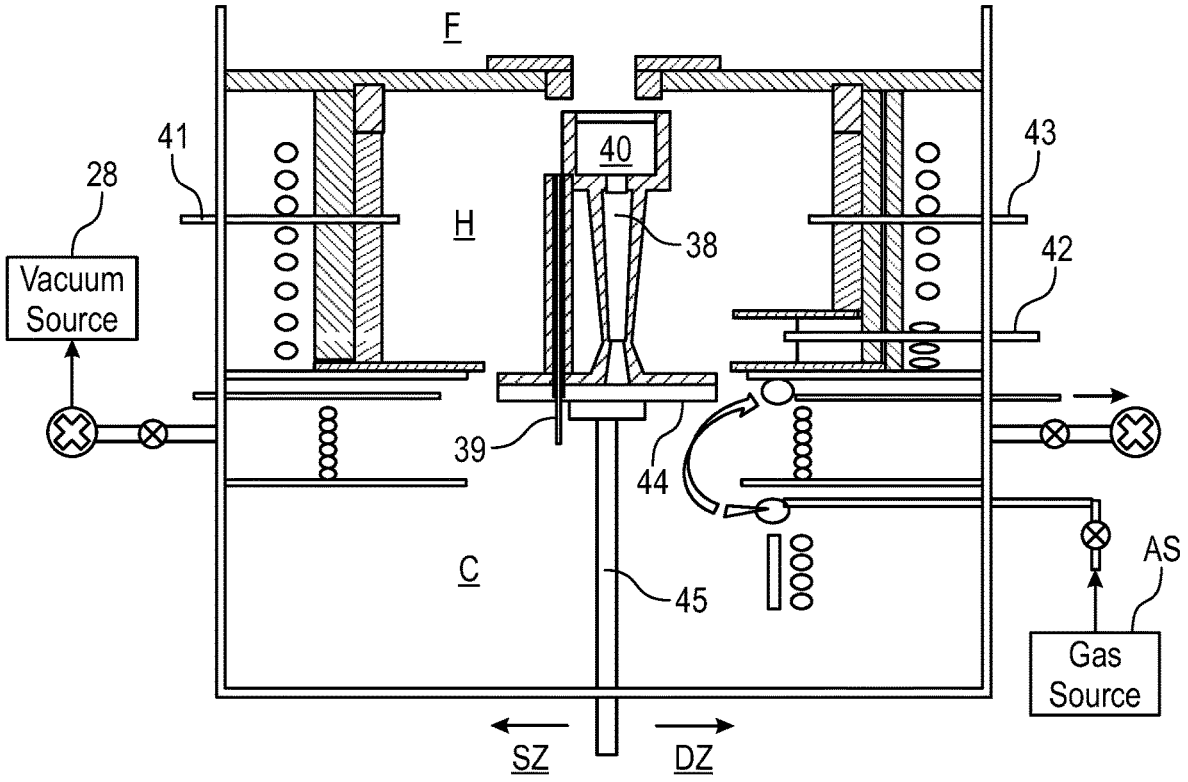
FIG. 4 is a schematic illustration of a mold used for casting directionally solidified alloy for documenting the effect of thermal gradient on structure, segregation and soundness, in accordance with one exemplary embodiment of the present invention.

Referring to FIG. 4, the schematics of the mold and furnace setup (single zone heating and cooling furnace setup SZ and dual zone heating and cooling furnace setup DZ) is shown, in accordance with one exemplary embodiment of the present invention. Here, a special mold 38 with slot for insertion of thermocouple 39 and a reservoir was fabricated for this evaluation. The reason for choice of in-situ melting stemmed from the need for an additional power supply needed for dual zone heating. The melt power supply was used as the auxiliary source to power the primary heating zone while the mold heating power supply was used for secondary heating. A laboratory 16" cubic zirconia single crystal furnace with 12" heating zone was modified to cast one mold with conventional single zone heating and cooling and two molds with dual zone heating and cooling per the present invention. A charge 40 was inserted into mold and cast separately under single and dual zone heating and cooling conditions. Thermocouple 41 was used to control heating of single zone furnace, while thermocouples 42 and 43 were used to control dual zone heating. The mold was loaded onto a chill plate 44 attached to a ram 45 in the mold cooling chamber C and the chamber was evacuated. The mold was then raised into preheated mold heating chamber H and soaked for one hour during which the metal melted and filled the mold. Both molds were withdrawn at 10"/hour for the first 30 minutes and 6"/hour for one hour with 1" transition in speed.

Figure 5:
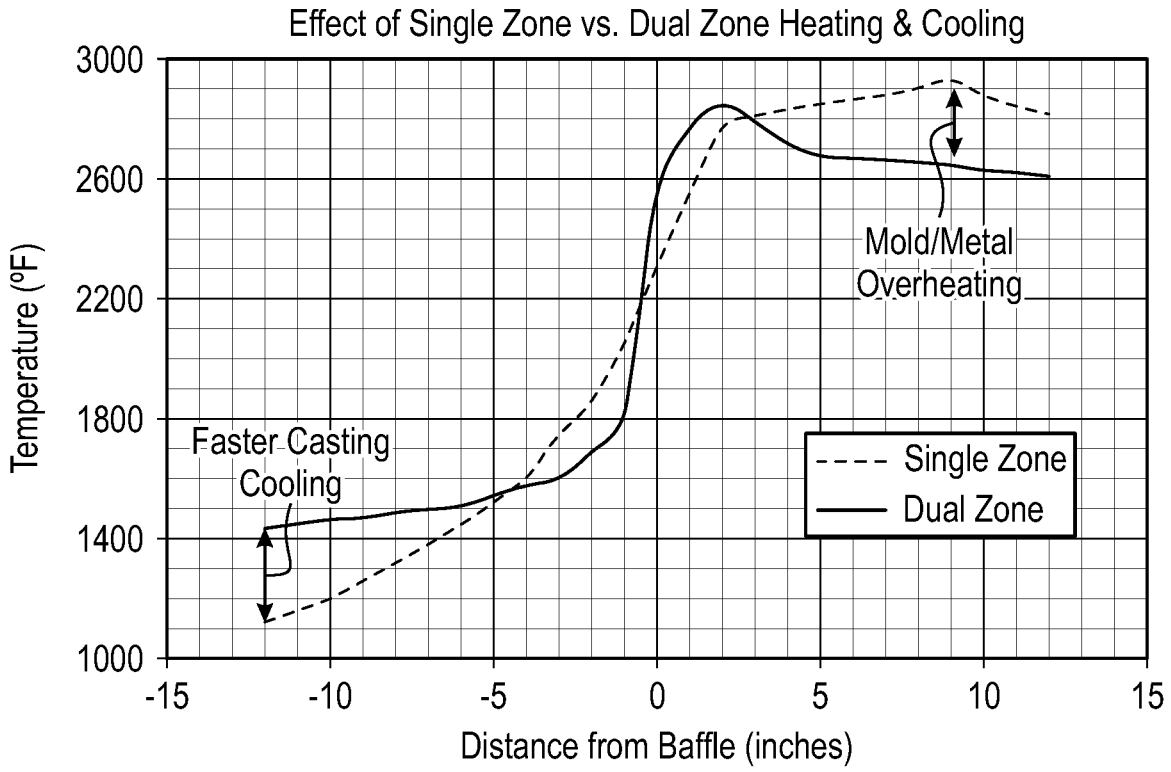
FIG. 5 illustrates the temperature profile comparison between conventional Bridgman and the casting furnace of the present invention.

FIG. 5, depicts the temperature recorded by the thermocouple 39 during the withdrawal of molds with single and dual heating and cooling. The alloy used in this evaluation was MarM247 with a melting range of 2350° F. to 2500° F. An analysis of thermocouple data in a 2" zone around the baffle separating PH and PC zones, where the solidification was occurring, show thermal gradients were 190° F./inch per single zone heating and cooling versus 425° F./inch for dual zone heating and cooling. The results clearly demonstrate that the dual zone heating and cooling with differentiated control of temperatures per the present invention, can significantly increase thermal gradient than possible in the conventional Bridgman furnace. To corroborate the benefits of ultra-high gradient solidification with dual heating and cooling, primary dendrite arms spacing was measured 3" and 9" from the bottom of the slabs. The primary dendrite spacings were 0.016" and 0.023" for single zone heated and cooled slab versus 0.012" and 0.016" for dual zone heated and cooled slab depicting increased refinement of microstructure with dual heating and cooling. The dual zone heated and cooled slab exhibited no bulging and significantly reduced porosity. Electron dispersive analysis of aluminum ratio between the dendritic and inter-dendritic regions showed dual zone heating and cooling improved the aluminum ratio from 0.65 for single zone heating and cooling to 0.81 for dual zone heating and cooling. As aluminum is a strong gamma prime former, a more uniformly dispersed aluminum permits full heat treatment which should help to improve strength and creep properties of turbine blades. Obviously, numerous modifications and variations of the present invention are possible in light of the above teachings. It is therefore to be understood that within the scope of the applied claims, the invention may be practiced otherwise than specifically described herein.

REFERENCE NUMERALS

Casting furnace 10
Melting chamber M
Furnace F
Mold heating chamber H
Mold cooling chamber C
Induction furnace 11
Molten alloy 12
Inlet 13
Insulating top cover 14
Mold cavity 15
Primary heating zone PH
Secondary heating zone SH
Baffle 16
Induction coil 17
Susceptor or graphite heating material 18
Insulation material 19
Dual thermocouple 20
Coil 21
Heating material 22
Insulation 23
Dual thermocouple 24
Baffle 25
Water-cooled copper shelf 26
Primary cooling chamber PC
Secondary cooling chamber SC
Water-cooled metal baffle 27
Vacuum source 28
Pump 29
Vacuum valve 30
Auxiliary gas source AS
Primary gas source PS
Blower B
Auxiliary fluid cooling 31
Manifold 32
Manifold 33
Dual thermocouple 34
Insulated metal shield 35
Resistance or induction heating coil 36
Dual thermocouple 37
Mold 38
Thermocouple 39
Charge 40
Thermocouple 41, 42, 43
Chill plate 44
Ram 45
Single zone heating and cooling furnace setup SZ
Dual zone heating and cooling furnace setup DZ

What is claimed is:

1. A casting furnace for solidification restructuring, said casting furnace comprising:

a melting chamber to provide a source of molten alloy or ceramics with adequate superheat;

a dual zone mold heating chamber comprising a primary heating zone and a secondary heating zone, wherein the primary heating zone and the secondary heating zone are independently controlled, wherein the primary heating zone raises a temperature of a mold for a duration above its creep onset temperature of the mold and thereby a molten metal contained in it near a baffle to impart gradient solidification conditions, and wherein the secondary heating zone heats a majority of the duration below the creep onset temperature of the mold and to provide a preheated mold to assist the primary heating zone to raise the temperature of the mold; and a dual zone mold cooling chamber comprising a primary cooling chamber and a secondary cooling chamber, wherein the primary cooling chamber and the secondary cooling chamber are independently controlled, wherein the primary cooling chamber speeds up the solidification to prevent defect formation and refine microstructure in a molten state, and wherein the secondary cooling chamber slows down cooling of castings solidified to reduce residual stresses build up, and minimize elemental segregation through augmenting solid-state diffusion of lower melting elements.

2. The casting furnace of claim 1, wherein the primary heating zone comprises compressed coils with dense heating elements to provide a source of intense concentrated heat to the baffle, minimize thermal fluctuation, and prevent magnetic flux leakage.

3. The casting furnace of claim 2, wherein the secondary heating zone (SH) is four times longer than the primary heating zone (PH), wherein the secondary heating zone (SH) comprises expanded coils and optimized heating elements of varying density to impart a more uniform temperature to the secondary heating zone (SH), and wherein the heating of the mold is maintained significantly below the ceramic creep onset temperature.

4. The casting furnace of claim 1, wherein the primary cooling chamber utilizes a low pressure high-volume gas, to impart uniform conductive cooling to permit recirculation to reduce gas consumption, and wherein the secondary cooling chamber is separated from the primary cooling chamber with a heat resistant metal baffle, wherein the secondary cooling chamber comprises a heat reflector/radiator shield with auxiliary heating to minimize heat losses from solidified metal to slow down its cooling in order to reduce residual stresses build up, casting distortion/cracking and promote solid state diffusion of low melting elements.

5. The casting furnace of claim 4, wherein the dual zone mold heating chamber and the dual zone mold cooling chamber harness the creep onset temperature of ceramic to provide a hotter molten metal in the primary heating zone near the baffle and this coupled with a lower primary cooling zone temperature through application of low-pressure, high-volume gas cooling to achieve a solidification gradient in excess of 450° F./inch.

6. The casting furnace of claim 5, wherein the reduced primary and secondary segregation of low melting elements resulting from solidification gradient and cooling facilitate full heat treatability of castings in order to prevent occurrence of incipient melting and recrystallization scrap.

* * * * *